United States Patent [19]

Teuscher

[11] Patent Number: 4,933,246

[45] Date of Patent: Jun. 12, 1990

[54] ELECTROPHOTOGRAPHIC IMAGING MEMBER WITH A COPOLYMER BLOCKING LAYER

[75] Inventor: Leon A. Teuscher, Webster, N.Y.

[73] Assignee: Xerox Corporation, Stamford, Conn.

[21] Appl. No.: 292,981

[22] Filed: Jan. 3, 1989

[51] Int. Cl.[5] ..... G03G 5/14

[52] U.S. Cl. ..... 430/64; 430/96

[58] Field of Search ..... 430/58, 59, 64, 60, 430/131, 96

[56] References Cited

U.S. PATENT DOCUMENTS

| | | | |
|---|---|---|---|
| 3,295,967 | 9/1963 | Schoenfeld | 96/1.5 |
| 3,932,179 | 1/1976 | Perez-Albuerne | 96/1.5 |
| 4,014,856 | 3/1977 | Gilliams et al. | 252/62.1 |
| 4,425,418 | 1/1984 | Iwaki et al. | 430/106 |
| 4,464,450 | 8/1984 | Teuscher | 430/59 |

FOREIGN PATENT DOCUMENTS

| | | |
|---|---|---|
| 57-210345 | 12/1982 | Japan . |
| 1151141 | 5/1969 | United Kingdom . |
| 2099600A | 12/1982 | United Kingdom . |

*Primary Examiner*—John L. Goodrow

[57] ABSTRACT

An electrophotographic imaging member comprising a supporting substrate having an electrically conductive surface, a polymeric blocking layer and at least one photoconductive layer, the polymeric blocking layer having a surface resistivity greater than about $10^{10}$ ohm/sq between the supporting substrate and the photoconductive layer, the blocking layer comprising the heat dried product of a coating mixture comprising a film forming acid, metal salt, or ester copolymer comprising a backbone chain of repeating hydrocarbon units and acidic or acid derivative groups as pendant side chains chemically bonded to the backbone chain, the acidic groups selected from the group consisting of sulfonic acids, carboxylic acids, phosphonic acids and acid anhydrides, and silica gel.

20 Claims, 5 Drawing Sheets

ELECTROPHOTOGRAPHIC IMAGING MEMBER WITH A COPOLYMER BLOCKING LAYER

BACKGROUND OF THE INVENTION

This invention relates in general to electrostatography and, more specifically, to a novel photoconductive device and processes for preparing and using the device.

In the art of xerography, a xerographic plate containing a photoconductive insulating layer is imaged by first uniformly electrostatically charging its surface. The plate is then exposed to a pattern of activating electromagnetic radiation, such as light, which selectively dissipates the charge in the illuminated areas of the photoconductive insulator while leaving behind an electrostatic latent image in the nonilluminated areas. This electrostatic latent image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with a uniform charge of a negative polarity and the supporting electrode is utilized as an anode. Obviously, the supporting electrode may also function as an anode when the charge transport layer is sandwiched between the anode and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain diamine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed, for example, in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above provide excellent images when charged with a uniform negative electrostatic charge, exposed to a light image and thereafter developed with finely developed electroscopic marking particles. However, when the supporting conductive substrate comprises a metal having an outer oxide surface such as aluminum oxide, difficulties have been encountered with these photosensitive members under extended electrostatographic cycling conditions found in high volume, high speed copiers, duplicators and printers. For example, it has been found that when certain charge generation layers comprising a resin and a particulate photoconductor are adjacent an aluminum oxide layer of an aluminum electrode, the phenomenon of "cycling-up" is encountered. Cycling-up is the build-up of residual potential through repeated electrophotographic cycling. Build-up of residual potential can gradually increase under extended cycling to as high, for example, as 300 volts. Residual potential causes the surface voltage to increase accordingly. Build-up of residual potential and surface voltage causes ghosting, increased background on final copies and cannot be tolerated in precision high-speed, high-volume copiers, duplicators, and printers.

It has also been found that photosensitive members having a homogeneous generator layer such as $As_2Se_3$ such as those disclosed in U.S. Pat. No. 4,265,990, exhibit "cycling-down" of surface voltage when exposed to high cycling conditions found in high speed, high volume copiers, duplicators and printers. When cycling-down occurs the surface voltage and charge acceptance decrease as the dark decay increases in the areas exposed and the contrast potential for good images degrades and causes faded images. This is an undesirable fatigue-like problem and is unacceptable for high speed, high volume applications.

The use of electrical blocking layers has reduced the "cycling-up" and "cycling-down" problems. One example is the use of siloxanes as described, for example in U.S. Pat. No. 4,464,450 to L. Teuscher, issued August 7, 1984. Excellent images may be obtained with the siloxanes described in U.S. Pat. No. 4,464,450. However, the siloxane film cannot be cast thick as required for some applications.

Copolymers of methyl vinyl ether and maleic anhydride such as the Gantrez AN resins from General Aniline & Film Corporation have been utilized in blocking layers. Unfortunately, these copolymers of methyl vinyl ether and maleic anhydride are sensitive to water and rapidly hydrolyze to form acidic products which are corrosive and attack metal ground planes of photoreceptors during cycling. Loss of the ground plane due to corrosion during cycling eventually prevents an electrophotographic imaging member from discharging. This is manifested by an increase in the background deposits in the final image during cycling. In addition, the mechanical properties of copolymers of methyl vinyl ether and maleic anhydride are affected at high humidity and cause flexible electrophotographic imaging members to delaminate. Under low humidity conditions, blocking layers containing copolymers of methyl vinyl ether and maleic anhydride or maleic anhydride tends to cycle down electrical surface potential. Cycle down affects the final copy by loss of contrast between exposed and unexposed areas. In addition, copolymers of methyl vinyl ether and maleic anhydride are sensitive to certain solvents utilized in subsequently applied layers and white spots may form in the final image. White spots are defined as electrical potential deficient spots. Hydrolysis of copolymers of methyl vinyl ether and maleic anhydride transforms the anhydride to the acid. The acid formed during storage will attack the metallic conductive layer and result in photoreceptors that will no longer discharge. Moreover, during cycling, corrosion of thin metal ground planes is accelerated and this will also result in photoreceptors that will no longer discharge. Also, when the acid is formed, coating with the material is restricted to coating with water and low molecular weight alcohols.

INFORMATION DISCLOSURE STATEMENT

U.S. Pat. No. 3,932,179 issued to E. A. Perez on January 13, 1976—A multilayer electrophotographic element is disclosed comprising a conducting layer, a photoconductive layer, and a polymeric interlayer having a surface resistivity greater than about $10^{12}$ ohm/sq between the conducting layer and the photoconductive layer. The interlayer comprises a blend of at least two distinct polymeric phases comprising: (a) a film forming water or alkali-water soluble polymer and (b) an electrically insulating, film forming, hydrophobic polymer.

U.S. Pat. No. 3,295,967 issued to S. J. Schoenfeld on January 3, 1967—An electrophotographic recording member is disclosed which contains a nonmetallic base of high electrical resistivity, a coating on the base for increasing the electrical conductivity, the coating comprising gelatinous hydrated silicic acid and a hygroscopic hydrated inorganic salt, and a photoconductive stratum covering the coating.

U.S. Pat. No. 4,464,450 issued to L. A. Teuscher on August 7, 1984—an electrostatographic imaging member is disclosed having electrically operative layers overlying a siloxane film coated on a metal oxide layer of a metal conductive anode, the siloxane having reactive OH and ammonium groups attached to silicon atoms.

U.K. Patent Application GB No. 2 009 600 A to Tadaju Fukuda et al, published April 23, 1982—A photoconductive member is disclosed comprising a support, a photoconductive layer constituted of an amorphous material comprising silicon atoms as a matrix and a barrier layer between the support and the photoconductive layer, the barrier layer comprising a first sub-layer constituted of an amorphous material comprising silicon atoms as a matrix and containing an impurity which controls the conductivity and a second sub-layer constituted of an electrically insulating material different from the amorphous material constituting the first sub-layer.

Thus, the characteristics of photosensitive members comprising a support having an electrically conductive surface, a blocking layer and at least one photoconductive layer, exhibit deficiencies under extended cycling conditions in electrophotographic imaging members.

SUMMARY OF THE INVENTION

It is an object of the invention to provide an electrophotographic imaging member which overcomes the above-noted disadvantages.

It is an another object of this invention to provide an electrostatographic imaging member having extend life.

It is another object of this invention to provide an electrostatographic imaging member that avoids the effects of ground plane corrosion.

It is another object of this invention to provide an electrostatographic imaging member which resists delamination during flexing.

It is another object of this invention to provide an electrostatographic imaging member which is more stable in environments of high and low relative humidity.

It is an object of the invention to provide an electrophotographic imaging member comprising a supporting substrate having an electrically conductive surface, a polymeric blocking layer and at least one photoconductive layer, the polymeric blocking layer having a surface resistivity greater than about $10^{10}$ ohm/sq between the supporting substrate and the photoconductive layer, the blocking layer comprising the heat dried product of a coating mixture comprising a film forming acid, metal salt, or ester copolymer comprising a backbone chain of repeating hydrocarbon units and acidic or acid derivative groups as pendant side chains chemically bonded to the backbone chain, the acidic groups selected from the group consisting of sulfonic acids, carboxylic acids, phosphonic acids and acid anhydrides, and silica gel. The imaging member is prepared by depositing on the electrically conductive surface a coating of a solution comprising a film forming acid, metal salt, or ester copolymer comprising a backbone chain of repeating hydrocarbon units and acidic or acid derivative groups as pendant side chains chemically bonded to the backbone chain, the acid groups selected from the group consisting of sulfonic acids, carboxylic acids, phosphonic acids and acid anhydrides, and silica gel, heating the solution to form a solid blocking layer and depositing at least one electrophotographic imaging layer on the blocking layer. This imaging member may be employed in an electrostatographic imaging process.

The supporting substrate layer having an electrically conductive surface may comprise any suitable rigid or flexible member such as a flexible web or sheet. The supporting substrate layer having an electrically conductive surface may be opaque or substantially transparent and may comprise numerous suitable materials having the required mechanical properties. For example, it may comprise an underlying insulating support layer coated with a thin flexible electrically conductive layer, or merely a conductive layer having sufficient internal strength to support the electrophotoconductive layer and ground strip layer. Thus, the electrically conductive layer may comprise the entire supporting substrate layer or merely be present as a component of the supporting substrate layer, for example, as a thin flexible coating on an underlying flexible support member. The electrically conductive layer may comprise any suitable electrically conductive organic or inorganic material. Typical electrically conductive layers including, for example, aluminum, titanium, nickel, chromium, brass, gold, stainless steel, carbon black, graphite, metalloids, cuprous iodide, indium tin oxide alloys, Lewis acid doped polypyrrole and the like. The conductive layer may vary in thickness over substantially wide ranges depending on the desired use of the electrophotoconductive member. Accordingly, the conductive layer can generally range, for example, in thicknesses of from about 50 Angstrom units to many centimeters. When a highly flexible photoresponsive imaging device is desired, the thickness of conductive layers may be between about 100 Angstroms to about 2,000 Angstroms. If an underlying flexible support layer is employed, it may be of any conventional material including metal, plastics and the like. Typical underlying flexible support layers include insulating or non-conducting materials comprising various resins or mixtures thereof with conductive particles, such as metals, carbon black and the like, known for this purpose including, for example, polyesters, polycarbonates, polyamides, polyurethanes, and the like. The coated or uncoated supporting substrate layer having an electrically conductive surface may be rigid or flexible and may have any number of different configurations such as, for example, a sheet, a cylinder, a scroll, an endless flexible belt, and the like. Preferably, the flexible supporting substrate layer having an electrically conductive surface comprises an endless flexible belt of commercially available polyethylene terephthalate polyester coated with a thin flexible metal coating.

A charge blocking layer is interposed between the conductive surface and the imaging layer if the imaging layer comprises an electrophotographic imaging layer. This blocking layer material traps charge. The blocking layer materials of this invention can form a layer which also functions as an adhesive layer. The charge blocking layer of this invention comprises the heat dried product of a coating mixture comprising a film forming acid, metal salt, or ester copolymer comprising a backbone chain of repeating hydrocarbon units and acidic or acid derivative groups as pendant side chains chemically bonded to the backbone chain, the acidic groups selected from the group consisting of sulfonic acids, carboxylic acids, phosphonic acids and acid anhydrides, and silica gel.

When anhydride, full acid or monoester of copolymers or mixtures thereof are employed as coreactants, a film forming reaction product of an alkali metal silicate or alkyl silicate and the salt, acid or ester of the copolymer is produced. Moreover, the acid environment causes silica gel to form in situ to inhibit or passivate the electrochemical erosion of underlying electrically conductive metal layers. The acidic groups as pendant side chains chemically bonded to the backbone chain may be selected from the group consisting of sulfonic acids, carboxylic acids, phosphonic acids and acid anhydrides. Pendant side chains composed of other groups, for example, such as cyano, halogen, hydrogen, hydroxy, alkoxy, and ester groups may also be present in the polymers. Typically, the polymers have 10 or more repeating units in the backbone chain. The number of repeating units should be sufficient for the polymer to form a solid film when dried. Examples of typical polymers include polyacrylic acid and polymethacrylic acid, copolymers of alpha, beta-ethylenically unsaturated carboxylic acids or anhydrides and other polymerizable alpha, beta-ethylenically unsaturated monomers such as a copolymers of an alkyl acrylate and/or alkyl methacrylate polymerized with methacrylic acid and/or acrylic acid or a copolymer of a vinyl ether and a maleic anhydride monomer; polymers and copolymers of alpha, beta-ethylenically unsaturated sulfonic acid monomers such as a polymer of a sulfonated styrene, vinyl sulfonic acid, vinyl phosphonic acid, and the like.

Copolymers that may be employed as a component in the blocking layer of this invention are film forming copolymers of one or more maleic monomers and one or more vinyl monomers. Typical maleic monomers include maleic anhydride and maleic acid. Representative of such maleic monomers are compounds having the following formula:

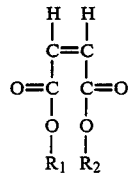

wherein $R_1$ and $R_2$, when taken separately, independently represent hydrogen or an alkyl group having from 1 to 12 carbon atoms, and when taken together, $R_1$ and $R_2$ represent an oxa group (i.e. —O—). Typical vinyl monomers include methyl vinyl ether, styrene, ethylene, acrylonitrile, butyl vinyl ether, ethyl vinyl ether, and the like.

Copolymers for use as a reactant to form the blocking layer of this invention include copolymers of vinyl monomers and maleic monomers which contain repeating units that may be represented as follows:

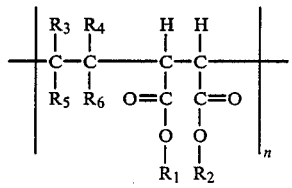

wherein $R_1$ and $R_2$, are as defined above and n is a number from 10 to 2,000. $R_4$, $R_5$, $R_5$ and $R_6$ are independently selected from H, halogen, cyano group, alkyl group, ester group, phenyl group, substituted phenyl group, and alkyl ether, the alkyl group in the alkyl ether being an alkyl, straight-or branched-chain, having from 1 to 6 carbon atoms or a substituted alkyl that has no deleterious effect on the polymerization.

Preferred copolymers for the blocking layer of this invention are film forming copolymers of one or more maleic monomers and one or more vinyl ethers. Typical vinyl ethers are alkyl vinyl ethers where the alkyl is acyclic, i.e., $CH_2{=}CH{-}O{-}R_7$ wherein $R_7$ is alkyl, straight- or branched-chain, having from 1 to 6 carbon atoms or substituted alkyl, where the substituents are those having no deleterious effect on the polymerization, e.g., halogen, hydroxy, etc. Typical film forming copolymers that are represented by the foregoing structure include the copolymers of methyl vinyl ether and maleic anhydride, styrene and maleic anhydride, ethylene and maleic andhydride, and the like, and mixtures thereof. A preferred reactive film forming polymer is a copolymer of maleic anhydride and a methyl vinyl ether, available, for example, as Gantrez AN 119, Gantrez AN 149, Gantrez AN 169, Gantrez and Gantrez AN 179 from General Aniline and Film Corporation (GAF). This can also be described as a copolymer of methyl vinyl ether and maleic anhydride. Other typical copolymers include poly(vinyl methyl ether-maleic anhydride), poly(vinyl chloromethyl ether-maleic anhydride), poly(vinyl isopropyl ether-maleic anhydride), poly(vinyl butyl ether-maleic anhydride), poly(vinyl isobutyl ether-maleic anhydride), copolymer of styrene and maleic anhydride (SMA Resin, available from Monsanto Company), copolymer of ethylene and maleic andhydride (EMA Resin, available from Monsanto Company), and the like, and mixtures thereof.

Typical mono ester copolymers include the monoethyl ester of poly(methylvinyl ether/maleic acid) in ethanol (Gantrez ES-225, available from GAF Corporation), monoisopropyl ester of poly(methylvinyl ether/maleic acid) (Gantrez ES-425, available from GAF Corporation) and the like, and mixtures thereof. The concentration of the insitu formed silica gel is less with monoesters than with full acid copolymers.

Other full acid copolymers of a maleic monomer and cyclic vinyl ethers include those in which the cyclic vinyl ether has 2 to about 8 carbon atoms and is represented as:

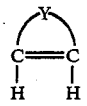

wherein Y represents the carbon and oxygen atoms necessary to complete a saturated, cyclic ether group, including poly ethers. A typical cyclic vinylene ether is p-dioxene which may be copolymerized, for example, with maleic anhydride.

The charge blocking layer of this invention may comprise the film forming reaction product of an alkali metal silicate or tetraalkyl silicate and a film forming full acid copolymer or half ester copolymer of one or more maleic monomers and one or more vinyl monomers described above. This reaction product may optionally be cross linked by reaction with a polyol. An example of a reaction product of a silicate salt or tetraalkyl silicate and a film forming full acid copolymer of one or more maleic monomers and one or more vinyl monomers may be represented by a structure having an ABABAB configuration such as:

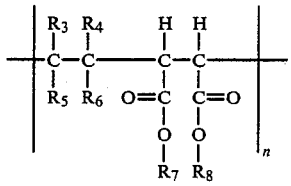

where $R_1$ and $R_2$ are independently selected from hydrogen, a metal ion, alkyl group, cycloalkyl group or aromatic group wherein at least $R_1$ or $R_2$ in the molecule is a metal ion, alkyl group, cycloallkyl group or aromatic group and n is a number from 10 to 2,000. The metal ions may be monovalent alkali metal such sodium, potassium, lithium and the like.

A "full acid" copolymer as employed herein is defined as a compound having a backbone chain of repeating hydrocarbon units and groups as pendant side chains chemically bonded to the backbone chain, the pendant side chains terminating with —COOH. For example, in the structure depicted in structural formula immediately above, $R_1$ and $R_2$ would both be hydrogen or a metal ion. Full acid copolymer compositions are generally more difficult to deposit as a coating from an organic solvent. Water may be utilized to deposit full acid copolymer compositions but wetting of organic or inorganic substrates is more difficult. Blocking layers containing full acid copolymer materials tend to delaminate at a high humidity and, therefore, are sensitive to high humidity.

Compositions containing the reaction product of a full acid copolymer and alkali metal silicate or tetraalkyl silicate (alkyl group may contain 1 to 4 carbon atoms) are only water soluble, difficult to apply as a coating (wetting may be improved by adding minor amounts of a wetting agent), avoids cycling down, prevents white spots and tends to delaminate with high humidity. However, full acid copolymer materials may be cross-linked with polyols to prevent delamination under humid conditions. Cross-linking renders the deposited coating less sensitive to humidity but the composition is difficult to apply as a coating because, unlike full ester compositions, it has a tendency to gel on standing because of the very reactive acid groups. Typical polyols include glycerol, ethylene glycol, diethylene glycol, triethanol amine, and the like and mixtures thereof. Generally, a mole ratio of 1 mole of copolymer to 0.2 to 0.03 moles of polyol is satisfactory.

A preferred combination for the blocking layer of this invention contains the reaction product of a full acid copolymer and alkali metal silicate or tetraalkyl silicate with or without the use of a polyol cross-linking agent. Any suitable polyol may be employed as the cross-linking agent. Because of the tendency to gel on standing, the mixture of a full acid copolymer and silicate should be applied promptly without prolonged storage.

A "half ester" copolymer as employed herein is defined as a compound having a backbone chain of repeating hydrocarbon units and groups as pendant side chains chemically bonded to the backbone chain, half of the pendant side chains terminating with —COOH or —COOM and the other half terminating with an ester group. For example, in the structure depicted in structural formula immediately above, one of $R_1$ and $R_2$ would be hydrogen or a metal ion and the other would be an alkyl, cycloalkyl or aromatic group.

The half ester copolymers are fully soluble in alcohol solvents and are not soluble in other organic solvents such as diethyl ether, hexane, and toluene. Thus, the deposited coatings are not affected by some of the organic solvents commonly employed to deposit subsequent layers and white spots are prevented. Unfortunately, blocking layers containing the half ester copolymer by itself causes cycling down of the photoreceptor. However, the addition of a silicate salt to the half ester composition prevents cycling down.

Compositions containing the combination of a half ester copolymer and alkali metal or tetralkyl silicate can be readily deposited as a coating from alcohol solutions to prevent cycling down and white spots. Moreover, half ester copolymers are less sensitive to humidity and delamination problems. Because the half ester copolymer has free acid moieties that can cross-linked with polyols such glycerol when heated to elevated temperatures greater than about 100° C., the coating becomes insoluble in most organic solvents contained in subsequently applied coatings because the half ester coating composition is cross-linked upon heating. Delamination under humid conditions is also prevented by cross-linking. Typical polyols include glycerol, ethylene glycol, diethylene glycol, triethanol amine, and the like and mixtures thereof. Generally, a mole ratio of 1 mole of copolymer to 0.15 to 0.03 moles of polyol is satisfactory.

Optimum blocking layer properties are achieved with half ester copolymer and silicate combinations because the composition is more stable during storage and will not cross-link until heated to a temperature greater than about 100° C. An especially preferred coating mixture composition of this invention comprises the monoethyl ester of poly(methylvinyl ether/maleic acid) in ethanol admixed with sodium or ethyl silicate.

A "full ester" copolymer as employed herein is defined as a compound having the structure depicted in structural formula immediately above where $R_1$ or $R_2$ are both an alkyl, cycloalkyl or aromatic group. Full ester copolymers alone fail to prevent cycling down at low relative humidities. The full ester is easily coated from solvents, i.e., it is more solvent compatible. It is also humidity resistant and resists delamination. However, it cannot be insolubilized because it cannot be cross-linked. Final, dried compositions containing only the combination of a full ester copolymer and alkali metal or alkyl silicate are easy to coat, prevent cycling down, do not delaminate under high humidity conditions, but are subject to white spot formations due to solvent attack during deposition of subsequently applied layers. Dried blocking layers containing the full ester and alkali metal and silica gel will not cycle down because of the presence of the silica gel. This dried coating may be made, for example, by reacting a half ester with an alkyl silicate or alkali metal silicate. Thus, the combination of only a full ester and alkali metal and silica gel does not perform as well as the full acid and half ester copolymer combinations, but may be suitable for applications such as drums in short run, low volume electrophotographic copiers and printers.

Alkali metal and silica gel employed alone in blocking layers prevent cycle down, but are only water soluble and difficult to apply as a coating. Typical alkali metals include sodium, lithium, potassium, and the like and mixtures thereof.

Blocking layers containing only silica gel prevent cycling down at low relative humidities. Thus, combinations of a full acid or half ester copolymer mixed with a commercially available silica gel after cross linking prevents cycle down at low RH and white spots but are difficult to prepare. However, silica gel formed in situ in blocking layer compositions of this invention containing a full acid or half ester in combination with an alkali metal silicate or tetraalkyl silicate is easily prepared. This is accomplished, for example, by reacting half a mole of tetraethyl silicate with a one mole equivalent of the copolymer of methyl vinyl ether and maleic anhydride to form the ethyl ester and silica gel.

A satisfactory reaction mixture ratio range is about 1 mole of full acid copolymer to about 0.5 mole to about 0.05 mole of alkyl silicate; about 1 mole of monoester copolymer to about 0.25 mole to about 0.05 mole of alkyl silicate; about 1 mole of full acid copolymer to about 0.5 mole to about 0.05 mole of alkali metal silicate; and about 1 mole of monoester copolymer to about 0.5 mole to about 0.05 mole of alkali metal silicate. The ranges in each of these categories ensure that a silica gel is formed insitu. Accordingly, mixtures of materials from different categories should be proportional to the ranges in each of the aforesaid categories.

The blocking layer mixture is applied to the conductive surface of the supporting substrate. The blocking layer mixture of this invention may be applied by any suitable conventional technique. Typical application techniques include spraying, dip coating, roll coating, wire wound rod coating, and the like. Coating compositions utilizing a full acid are applied with water as the carrier fluid. For coating compositions containing a full ester copolymer, typical carrier fluids include alcohols containing from 1 to 6 carbon atoms such as ethanol and methanol alone or in combination with other carrier fluids such as tetrahydrofuran, alkoxy propylene glycol, ketones, alkyl esters and the like. For the monoester copolymer, the solvents are usually selected from suitable conventional organic solvents such as lower alcohols, ketones, cycloketones, esters, ethers (e.g. ether glycols, 2 methoxy propylene glycol and cyclic ethers), and the like. For applying coatings containing the monoester copolymer an aliphatic alcohol containing 1 to 4 carbon atoms such as methanol or an ether glycol (e.g. 2 methoxy propylene glycol) may be employed. Choice of solvents depends upon the nature of the conductive layer upon which the barrier layer is applied and also on the properties of the copolymers constituting the blocking layer. Appropriate solvents can, in general, be selected based on the known properties of the individual polymers, as is well known in the art. Mixtures of solvents may also be used, if desired. The proportion of carrier fluid to be utilized varies with the type of coating technique to be employed, e.g., dip coating, spray coating, wire wound bar coating, roll coating, and the like so that the viscosity of the coating mixture is adjusted to the type of coating technique utilized. Generally, the amount of liquid carrier ranges from between about 99.8 percent by weight to about 90 percent by weight, based on the total weight of the coating composition.

Minor amounts of optional additives may be added to the blocking layer coating composition, if desired, to the coating mixture to promote improved wetting of the electrically conductive surface of the supporting substrate. Any suitable additive may be employed. Typical additives include wetting agents such as Surfy-nol (available from Airco Chemicals and Plastics) and the like. Other additives include plasticizers such as glycerol, diethylene glycol, p-toluene ethyl sulfonamide, and the like. Similarly, other additives such as dyes and the like may also be added. Generally, the amount of optional additive added should be less than about 15 percent by weight, based on the total weight of the dried coating.

After the blocking layer coating is applied, the deposited coating is heated to drive out the solvent and form a solid film. Generally, a drying temperature between about 100° C. and about 150° C. is preferred for maximum stabilization of electrochemical properties. The temperature selected depends to some extent on the specific electrically conductive layer utilized and is limited by the temperature sensitivity of the substrate. The drying temperature may be maintained by any suitable technique such as ovens, forced air ovens, radiant heat lamps, and the like. The drying time depends upon the temperatures used. Thus less time is required when higher temperatures are employed. Generally, increasing the time increases the amount of solvent removed. One may readily determine whether sufficient drying has occurred by chromatographic or gravimetric analysis. Coating compositions containing the half ester or full acid become insoluble in the solvent that is employed to apply the coating. This insolubility is the result of cross-linking and is important because the solvent of the subsequently applied coating solutions may adversely affect the blocking layer if the blocking layer were soluble in solvents. A typical treatment involves application of the coating with a half mil Bird coating bar followed by heating of the deposited coating at 130° C. for about 5 minutes. Generally, satisfactory results may be achieved with a dried coating thickness between about 0.01 micrometer to 1 micrometer. Optimum results are achieved with thicknesses between about 0.04 micrometer to about 0.1 micrometer. When the thickness of the layer exceeds about 1 micrometer, the electrophotographic imaging member may show poor discharge characteristics and residual voltage build-up after erase during cycling. The surface resistivity of the dry blocking layer of the present invention should be greater than about $10^{10}$ ohms/sq as measured at room temperature (25° C.) and one atmosphere pressure under 40 percent relative humidity conditions. This minimum electrical resistivity prevents the blocking layer from becoming too conductive.

If desired, an optional adhesive layer may be utilized. Any suitable adhesive material may be applied to the blocking layer. If such layers are utilized, they preferably have a dry thickness between about 0.01 micrometer to about 1 micrometer. Typical adhesive layers include film-forming polymers such as polyester, polyvinylbutyral, polyvinylpyrolidone, polyamide, polyurethane, polymethyl methacrylate and the like.

Generally, the electrophotoconductive imaging member of this invention comprises a supporting substrate layer having an electrically conductive surface, a blocking layer and a photoconductive imaging layer. The photoconductive layer may comprise any suitable photoconductive material well known in the art. Thus, the photoconductive layer may comprise of a homogeneous photoconductive material, photoconductive particles dispersed in a binder, or multiple layers such as a charge generating overcoated with a charge transport layer. The layer may contain homogeneous, heterogeneous, inorganic or organic compositions. One example of an electrophotographic imaging layer containing a heterogeneous composition is described in U.S. Pat. No. 3,121,006 wherein finely divided particles of a photoconductive inorganic compound is dispersed in an electrically insulating organic resin binder. The entire disclosure of this patent is incorporated herein by reference. Other well known electrophotographic imaging layers include amorphous selenium, halogen doped amorphous selenium, amorphous selenium alloys including selenium arsenic, selenium tellurium, selenium arsenic antimony, and halogen doped selenium alloys, cadmium sulfide and the like. Generally, these inorganic photoconductive materials are deposited as a relatively homogeneous layer.

This invention is particularly desirable for electrophotographic imaging layers which comprise two electrically operative layers, a charge generating layer and a charge transport layer.

Any suitable charge generating or photogenerating material may be employed as one of two electrically operative layers in the multilayer photoconductor of this invention. Typical charge generating material include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brillant Scarlet and Indofast Orange. Other examples of charge generator layers are disclosed in U.S. Pat. No. 4,265,990, U.S. Pat. No. 4,233,384, U.S. Pat. No. 4,471,041, U.S. Pat. No. 4,489,143, U.S. Pat. No. 4,507,480, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent or less by volume of the binder layer with no limitation on the maximum amount of photoconductor in the binder layer. Generally for generator layers containing an electrically active matrix or binder such as polyvinyl carbazole or poly(hydroxyether), from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder. The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. a rate sufficient to prevent the formation and retention of an electrostatic latent image thereon.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4'-4''-bis(diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an active resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

In all of the above charge transport layers, the activating compound which renders the electrically inactive polymeric material electrically active should be present in amounts of from about 15 to about 75 percent by weight.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

BRIEF DESCRIPTION OF THE DRAWINGS

A more complete understanding of the processes and device of the present invention can be obtained by reference to the accompanying drawings wherein:

Referring to FIG. 1, a multilayered photoreceptor embodiment of this invention is shown comprising a flexible polymeric substrate 10, a conductive layer 12 comprising a metallic layer having a metal oxide upper surface, a blocking layer 14 prepared from a copolymer and silicate mixture, a polymeric adhesive layer 16, a charge generating layer 18, and a charge transport layer 20.

Figure 1:
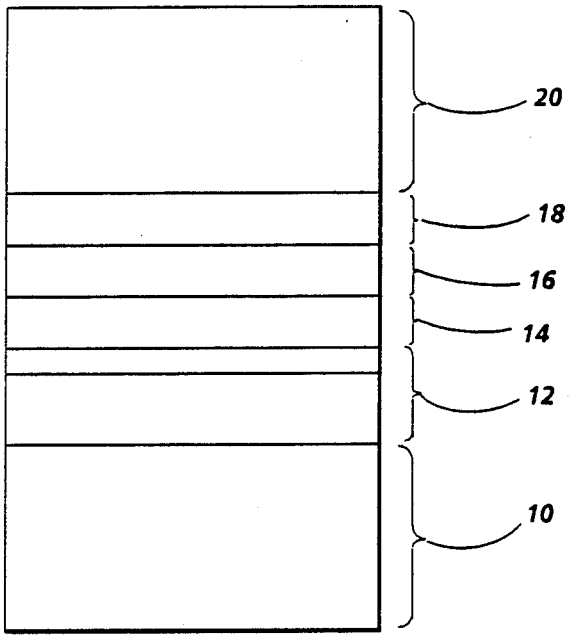
FIG. 1 schematically illustrates a multilayered photoreceptor embodiment of this invention in which the blocking layer and an adhesive layer are interposed between a metal oxide layer of a conductive metal layer and at least two electrically operative layers.
Figure 2:
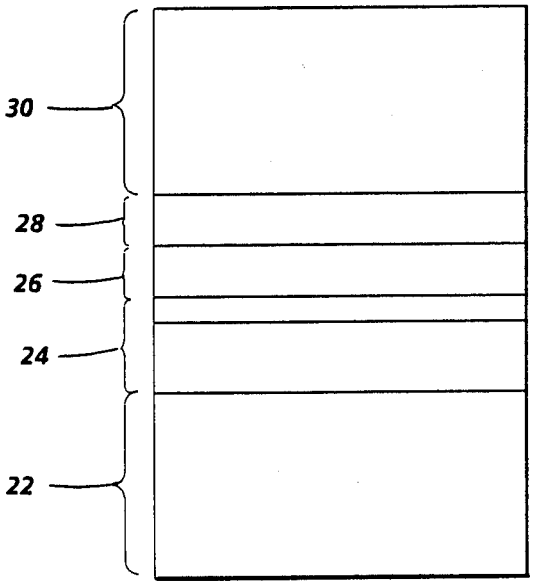
FIG. 2 schematically illustrates another multilayered photoreceptor embodiment of this invention in which the blocking layer of this invention is interposed between a metal oxide layer of a conductive metal layer and at least two electrically operative layers.

Illustrated in FIG. 2, is another embodiment of a multilayered photoreceptor of this invention. This photoreceptor comprises a flexible polymeric substrate 22, a conductive layer 24 comprising a metallic layer having a metal oxide upper surface, a blocking layer 26 prepared from a copolymer and silicate mixture, a charge generating layer 28, and a charge transport layer 30.

Thus, this invention extends the life of electrostatographic imaging members. It also reduces ground plane corrosion and delamination. Further, the electrostatographic imaging member of this invention is more stable in environments of high and low relative humidity.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Figure 3:
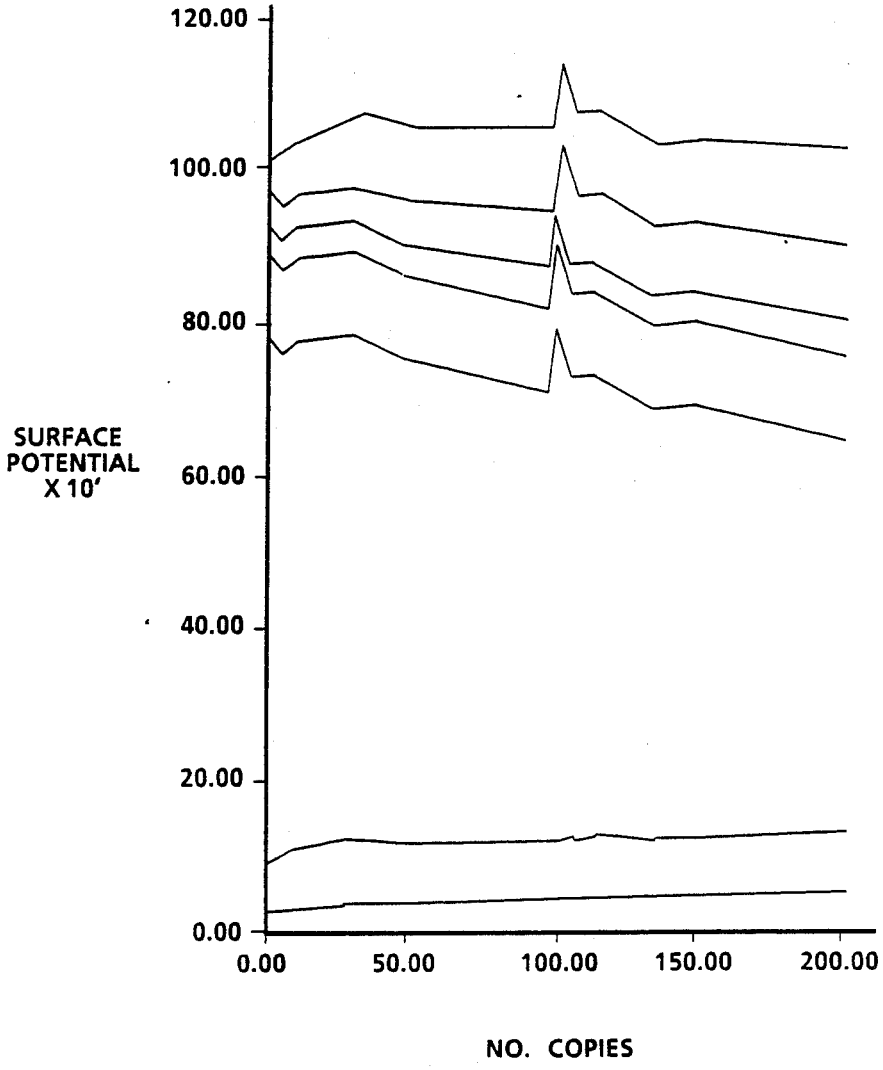
FIG. 3 graphically illustrates the cycling effects of photosensitive member in which only an adhesive layer is interposed between a metal oxide layer of a conductive metal anode layer and at least two electrically operative layers.

An aluminized polyester film, Mylar, in which the aluminum had a thickness of about 750 Angstroms, was exposed to ambient air to form an oxidized outer surface. A solution of about 0.5 percent by weight based on the total weight of the solution of polyester resin (49,000, available fro E. I, duPont de Nemours & Co.) dissolved in a 70:30 by volume ratio of tetrahydrofuran and cyclohexanone was applied to the oxidized aluminum surface. The resulting coating was dried to form an adhesive coating having a thickness of about 0.04 micrometer. A 10 percent solids dispersion of 10 volume percent trigonal selenium having a particle size between about 0.05 micron to about 0.20 micron and about 90 volume percent of polyvinylcarbazole in tetrahydrofuran/toluene (50:50 weight ratio) was prepared in an attritor. This mixture was applied with a 0.0005 inch Bird applicator to the adhesive layer. The coated device was then allowed to dry at 135° C. for 3 minutes resulting in the formation of a photoconductive layer having a dry thickness of about 1.8 micrometers containing about 10 volume percent of trigonal selenium dispersed in about 90 volume percent of polyvinylcarbazole. The generating layer was then overcoated with a 25 micron thick charge transport layer containing about 50 percent by weight N,N'-diphenyl-N,N'-bis(3-methylphenyl)1,1'-biphenyl-4,4'-diamine dispersed in about 50 percent by weight of polycarbonate resin, Makrolon, available from Bayer Corporation. The resulting photosensitive member having two electrically operative layers was subjected to electrical cycling in a continuous rotating scanner for 20,000 cycles at less than about 15 percent relative humidity and 28° C. The continuously rotating scanner subjected the photosensitive member fastened to a drum having a 30 inch circumference rotated at 30 inches per second to electrical charging and discharging during each complete rotation. During each complete 360° rotation, charging occurred at 0°, charging surface potential was measured at 22.5°, light exposure was effected at 78.75°, discharged surface potential measured immediately after light exposure, development surface potential measured at 236.25°, and erase exposure was effected at 258.75° which gives the residual potential. As shown in FIG. 3, the surface potential decreased dramatically with number of cycles and renders the photosensitive member unacceptable for making quality images in precision, high volume, high speed copiers, duplicators and printers unless expensive sophisticated equipment is employed to compensate for the large change in surface charge.

EXAMPLE II

Figure 4:
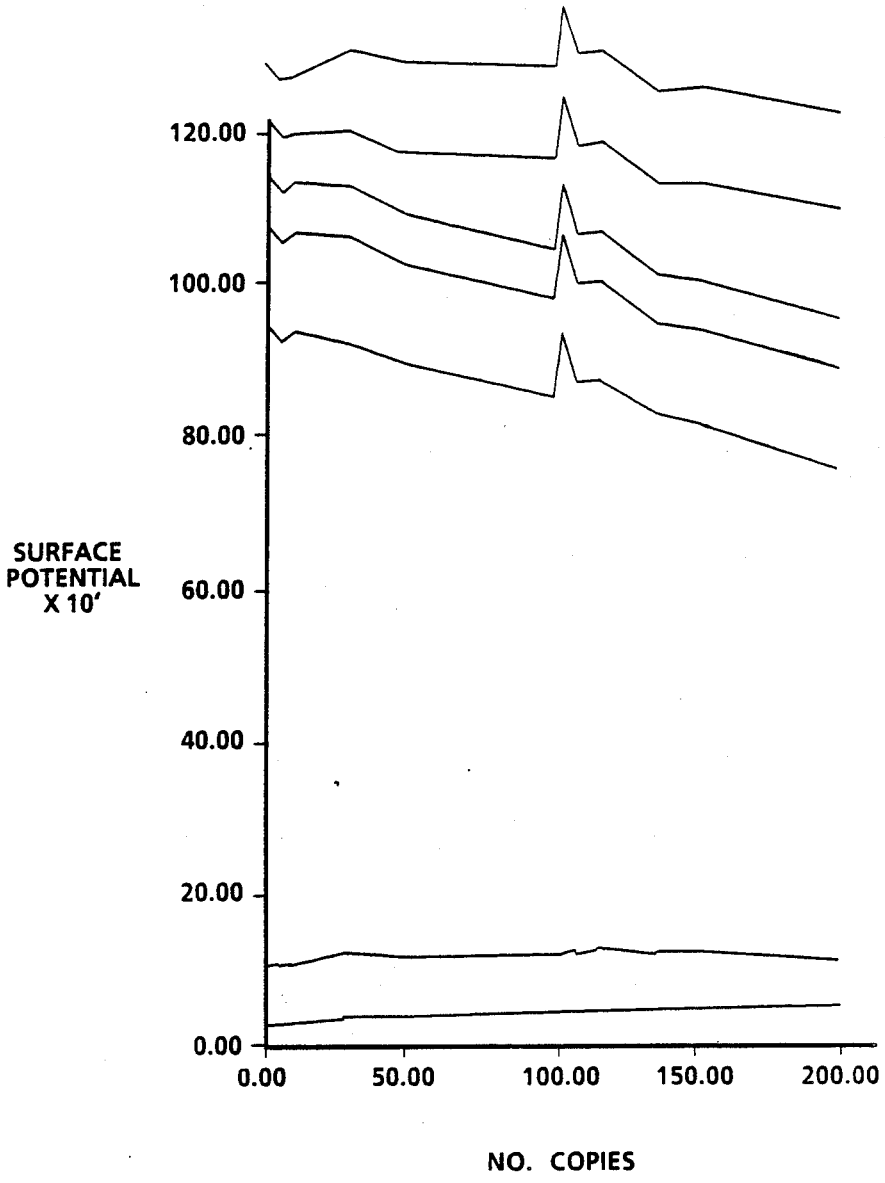
FIG. 4 graphically illustrates the cycling effects of photosensitive member in which a copolymer blocking layer and an adhesive layer are interposed between a metal oxide layer of a conductive metal anode layer and at least two electrically operative layers.

An aqueous solution was prepared containing about 5 percent by weight, based on the total weight of the solution (0.032 mole), of a film forming full acid copolymer of vinyl methyl ether and maleic anhydride (Gantrez AN 169, available from GAF). One gram of this solution was combined with 9 grams of 200 proof ethanol to form a 0.5 percent concentration solution. This solution has a pH of about 2 and was applied with a 0.0005 inch Bird applicator onto the surface of an aluminized polyester film Mylar and thereafter dried at a temperature of about 100° C. in a forced air oven for about 3 minutes to form a solid blocking layer having a thickness of about 0.05 micrometer. The adhesive layer, hole generating layer and hole transport layer described in Example I were then applied to the blocking layer of the in the same manner as that described in Example I. The resulting photosensitive member having two electrically operative layers were subjected to electrical cycling in a continuous rotating scanner for 20,000 cycles at less than 15 percent relative humidity. As shown in FIG. 4, the surface potential decreased with number of cycles and renders the photosensitive member unacceptable for making quality images in precision, high volume, high speed copiers, duplicators and printers unless expensive sophisticated equipment is employed to compensate for the large change in surface charge.

EXAMPLE III

Figure 5:
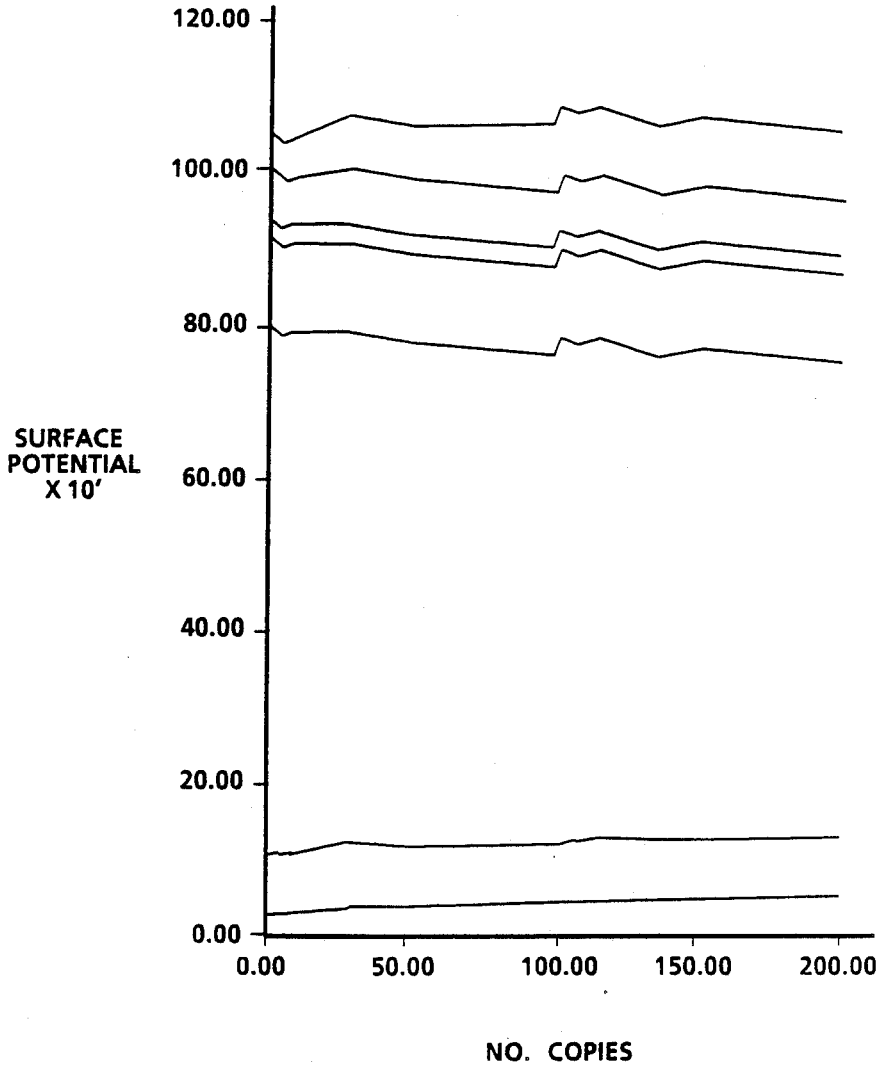
FIG. 5 graphically illustrates the cycling effects of a photosensitive member having a copolymer and silicate blocking layer and adhesive layer are interposed between an metal oxide layer of a conductive metal anode layer and two electrically operative layers.

An aqueous solution was prepared containing about 5 percent by weight, based on the total weight of the solution (0.032 mole), of a film forming full acid copolymer of vinyl methyl ether and maleic anhydride (Gantrez AN 169, available from GAF) and about 0.97 percent by weight, based on the total weight of the solution (0.008 mole), of sodium metasilicate (full acid copolymer to sodium silicate mole ratio of 1:0.25). This solution was applied with a 0.0005 inch Bird applicator onto the surface of an aluminized polyester film Mylar and thereafter dried at a temperature of about 100° C. in a forced air oven for about 3 minutes to form a solid blocking layer having a thickness of about 0.05 micrometer. The adhesive layer, hole generating layer and hole transport layer described in Example I were then applied to the blocking layer of the in the same manner as that described in Example I. The resulting photosensitive member having two electrically operative layers were subjected to electrical cycling in a continuous rotating scanner for 20,000 cycles at less than 15 percent relative humidity. As shown in FIG. 5, the surface potential remained substantially stable with number of cycles and renders the photosensitive member acceptable for making quality images in precision, high volume, high speed copiers, duplicators and printers.

EXAMPLE IV

Figure 6:
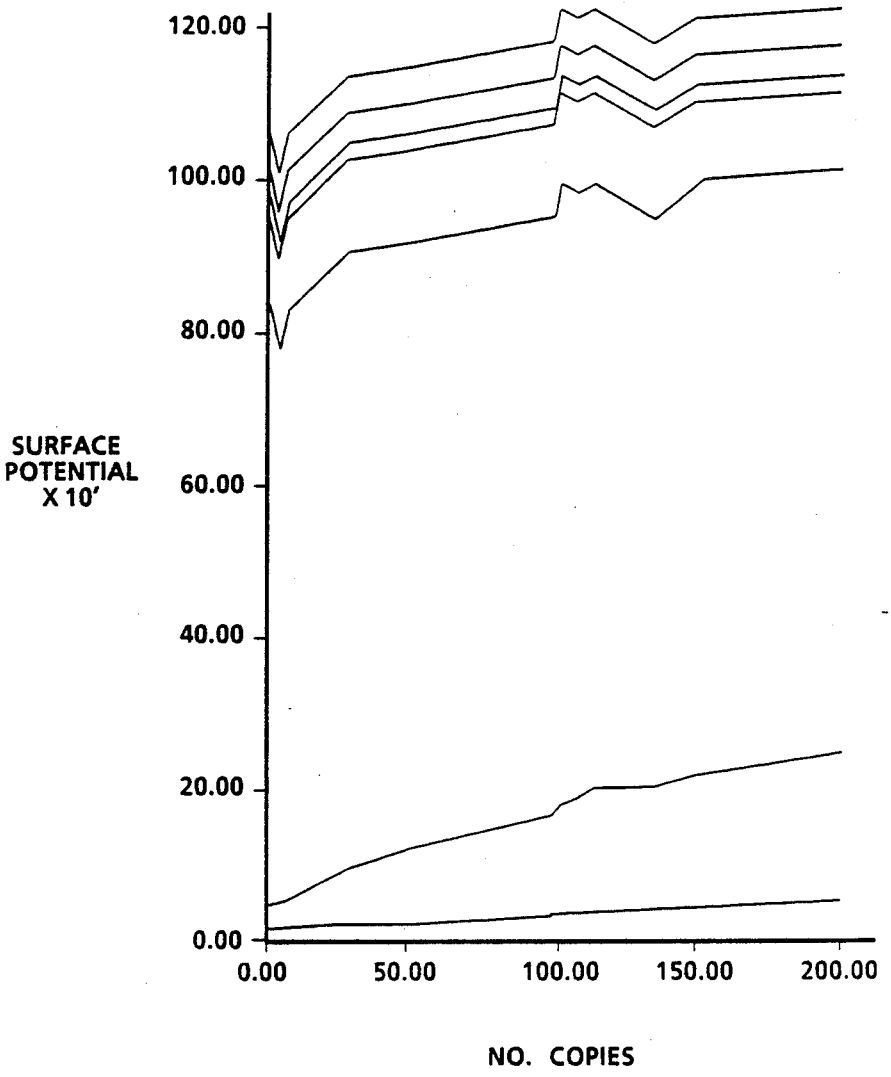
FIG. 6 graphically illustrates cycling effects of a photosensitive member having a copolymer and silicate blocking layer and adhesive layer are interposed between an metal oxide layer of a conductive metal anode layer and two electrically operative layers.

An aqueous solution was prepared containing about 5 percent by weight, based on the total weight of the solution (0.032 mole), of a film forming full acid copolymer of vinyl methyl ether and maleic anhydride (Gantrez AN 169, available from GAF) and about 1.94 percent by weight, based on the total weight of the solution 0.0016 mole), of sodium metasilicate (full acid copolymer to sodium silicate mole ratio of 1:0.5). This solution was applied with a 0.0005 inch Bird applicator onto the surface of an aluminized polyester film Mylar and thereafter dried at a temperature of about 100° C. in a forced air oven for about 3 minutes to form a solid blocking layer having a thickness of about 0.05 micrometer. The adhesive layer, hole generating layer and hole transport layer described in Example I were then applied to the blocking layer of the in the same manner as that described in Example I. The resulting photosenstive member having two electrically operative layers were subjected to electrical cycling in a continuous rotating scanner for 20,000 cycles at less than 15 percent relative humidity. As shown in FIG. 6, the surface potential increased with number of cycles and renders the photosensitive member marginally acceptable for making images in precision, high volume, high speed copiers, duplicators and printers unless expensive sophisticated equipment is employed to compensate for the large change in surface charge.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a supporting substrate having an electrically conductive surface, a polymeric blocking layer and at least one photoconductive layer, said polymeric blocking layer having a surface resistivity greater than about $10^{10}$ ohm/sq, between said supporting substrate and said photoconductive layer, said blocking layer comprising the heat dried product of a coating mixture comprising silica gel and a film forming acid, metal salt, or ester of a copolymer comprising a backbone chain of repeating hydrocarbon units and acidic or acid derivative groups as pendant side chains chemically bonded to said backbone chain, said acidic groups selected from the group consisting of sulfonic acids, carboxylic acids, phosphonic acids and acid anhydrides.

2. An electrophotographic imaging member according to claim 1 wherein said copolymer in said coating mixture prior to forming said acid, metal salt, or ester and drying is a full acid copolymer.

3. An electrophotographic imaging member according to claim 1 wherein said copolymer in said coating mixture prior to to forming said acid, metal salt, or ester and drying is a monoester copolymer.

4. An electrophotographic imaging member according to claim 1 wherein said copolymer in said dried product prior to to forming said acid, metal salt, or ester and drying is a full ester copolymer.

5. An electrophotographic imaging member according to claim 1 wherein said blocking layer has a thickness between about 0.01 micrometer to 0.5 micrometer.

6. An electrophotographic imaging member according to claim 1 wherein said photoconductive layer comprises a charge generation layer and a charge transport layer.

7. An electrophotographic imaging member according to claim 1 wherein said copolymer has the following formula:

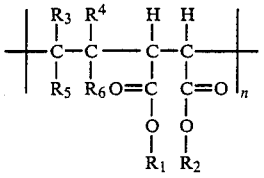

where $R_1$ and $R_2$ are independently selected from hydrogen, a metal ion, alkyl group, cycloalkyl group or aromatic group, $R_3$, $R_4$, $R_5$ and $R_6$ are independently selected from H, halogen, cyano group, alkyl group, ester group, phenyl group, substituted phenyl group, and alkyl ether group, and n is number from 10 to 2,000.

8. An electrophotographic imaging member according to claim 1 wherein said copolymer prior to to forming said acid, metal salt, or ester and drying comprises a copolymer of a vinyl monomer and a maleic monomer.

9. An electrophotographic imaging member according to claim 1 wherein said copolymer prior to to forming said acid, metal salt, or ester and drying is a full acid poly(vinyl methyl ether-maleic anhydride).

10. An electrophotographic imaging member according to claim 1 wherein said dried product comprises the reaction product of a full acid or monoester copolymer cross linked with a polyol.

11. An electrophotographic imaging member according to claim 10 wherein the mole ratio of said copolymer to said polyol is 1 mole of copolymer to 0.2 to 0.03 moles of polyol.

12. A process for preparing an electrophotographic imaging member comprising providing an electrophotographic imaging member comprising a supporting substrate having an electrically conductive surface, depositing on said electrically conductive surface a coating of a solution comprising silica gel and a film forming acid, metal salt, or ester of a copolymer comprising a backbone chain of repeating hydrocarbon units and acidic or acid derivative groups as pendant side chains chemically bonded to said backbone chain, said acid groups selected from the group consisting of sulfonic acids, carboxylic acids, phosphonic acids and acid anhydrides, heating said solution to form a solid blocking layer and depositing at least one electrophotographic imaging layer on said blocking layer.

13. A process for preparing an electrophotographic imaging member according to claim 12 including selecting a full acid copolymer as said copolymer, selecting sodium metasilicate, forming a mixture of said full acid copolymer and said sodium metasilicate in water to form said silica gel in situ, applying said mixture to said electrically conductive surface to form a coating and drying said coating at a temperature of at least 100° C.

14. A process for preparing an electrophotographic imaging member according to claim 12 wherein said solid blocking layer comprises a reaction product of a full acid copolymer and an alkyl silicate, the mole ratio of said full acid copolymer to said alkyl silicate or alkali metal silicate being about 1 mole of full acid copolymer to about 0.5 mole to about 1.5 moles of alkyl silicate.

15. A process for preparing an electrophotographic imaging member according to claim 2 wherein said solid blocking layer comprises a reaction product of a monoester copolymer and an alkyl silicate, the mole ratio of said monoester copolymer to said alkyl silicate being about 1 mole of monoester copolymer to about 0.25 mole to about 0.05 moles of alkyl silicate.

16. A process for preparing an electrophotographic imaging member according to claim 12 wherein said solid blocking layer comprises a reaction product of a full acid copolymer and an alkali metal silicate, the mole ratio of said full acid copolymer to said alkali metal silicate being about 1 mole of full acid copolymer to about 0.5 mole to about 0.025 moles of alkali metal silicate.

17. A process for preparing an electrophotographic imaging member according to claim 12 wherein said solid blocking layer comprises a reaction product of a monoester copolymer and an alkali metal silicate, the mole ratio of said monoester copolymer to said alkali metal silicate being about 1 mole of monoester copolymer to about 0.5 mole to about 0.05 moles of alkali metal silicate.

18. A process for preparing an electrophotographic imaging member according to claim 12 including depositing said electrophotographic imaging layer as a charge generating layer and a charge transport layer.

19. A process for preparing an electrophotographic imaging member according to claim 12 wherein said copolymer is monoethyl ester of poly(methylvinyl ether/maleic acid) dissolved in ethanol and said silica gel is formed in situ from a reactant selected from the group consisting of sodium silicate and ethyl silicate.

20. A process for preparing an electrophotographic imaging member according to claim 12 wherein said copolymer has the following formula

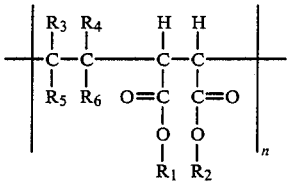

where $R_1$ and $R_2$ are independently selected from hydrogen, a metal ion, alkyl group, cycloalkyl group or aromatic group, $R_4$, $R_5$, $R_5$ and $R_6$ are independently selected from H, halogen, cyano group, alkyl group, ester group, phenyl group, substituted phenyl group, and alkyl ether group, and n is a number from 10 to 2,000.

* * * * *